US006094758A

United States Patent [19]

Renfro

[11] Patent Number: 6,094,758

[45] Date of Patent: Aug. 1, 2000

[54] WATERBED MATTRESS SYSTEM FOR BOATS

[76] Inventor: William L. Renfro, 1431 33rd St., NW., Washington, D.C. 20007

[21] Appl. No.: 09/110,021

[22] Filed: Jul. 2, 1998

[51] Int. Cl.[7] ..... A47C 27/08; B63B 17/00

[52] U.S. Cl. ..... 5/118; 5/672; 5/922; 114/343; 440/88

[58] Field of Search ..... 5/422, 665, 671, 5/672, 118; 114/343, 382; 440/88

[56] References Cited

U.S. PATENT DOCUMENTS

| | | | |
|---|---|---|---|
| 1,212,479 | 1/1917 | Hall | 5/665 |
| 3,456,270 | 7/1969 | Weinstein et al. | 5/665 |
| 3,585,356 | 6/1971 | Hall . | |
| 3,760,147 | 9/1973 | Tyrey | 5/422 X |
| 3,772,717 | 11/1973 | Yuen et al. | 5/422 |
| 3,879,598 | 4/1975 | Darling | 5/672 |
| 4,057,862 | 11/1977 | LaBianco . | |
| 4,109,333 | 8/1978 | Zmiarovich . | |
| 4,422,194 | 12/1983 | Viesturs et al. . | |
| 4,521,929 | 6/1985 | Keefer . | |
| 4,627,121 | 12/1986 | Winther . | |
| 4,707,872 | 11/1987 | Hessel . | |
| 4,708,084 | 11/1987 | Campau | 114/343 X |
| 4,736,478 | 4/1988 | Dangerously . | |
| 4,737,998 | 4/1988 | Johnson, Sr. . | |
| 4,947,500 | 8/1990 | Seiler . | |
| 5,005,238 | 4/1991 | Freet . | |
| 5,617,811 | 4/1997 | Johnson | 440/88 X |

FOREIGN PATENT DOCUMENTS

| | | | |
|---|---|---|---|
| 5277021 | 10/1993 | Japan | 5/422 |

*Primary Examiner*—Michael F. Trettel
*Attorney, Agent, or Firm*—Fisher, Christen & Sabol

[57] ABSTRACT

A waterbed mattress system for boats and, in particular, to a waterbed system for a boat having a cabin at least partially below a deck which includes a waterbed mattress which can be filled from a body of water surrounding the boat through the hull of the boat or from an internal or external supply through a series of tubes and a pump.

48 Claims, 2 Drawing Sheets

WATERBED MATTRESS SYSTEM FOR BOATS

FIELD OF THE INVENTION

Field of the Invention

The invention relates to a waterbed and water mattress system for boats and, in particular, to a waterbed system for a boat preferably having a cabin above and/or below a deck, which includes a waterbed mattress and means for transporting water or other liquid to and into the waterbed mattress from a body of water surrounding the boat or from an internal or external water or other liquid source.

BROAD DESCRIPTION OF THE INVENTION

An object of the invention is to achieve the advantages of a waterbed mattress in providing cool sleeping accommodations in a warm climate without an air conditioning system or warm sleeping accommodations in a cold climate while overcoming the disadvantages and problems of using waterbeds and water mattresses in boats. For example, prior to this invention, to have cool sleeping accommodations in warm climates, boats required expensive, noisy, vibrating air conditioning unit(s) and generator(s) to power them. The utility of boats without cool sleeping accommodations is severely limited in the warmest months. If one were to use a waterbed or a water mattress in a boat, the water filled mattress would be too heavy to carry onto the deck from below in the cabin each morning in order to empty out the water in the mattress. Unless one would empty the water in the water mattress into a bucket or other container and, then, carried it up to the deck to be emptied, the boat would have to carry around the considerable weight of the water in the mattress, necessarily slowing down the boat, affecting its stability and sea worthiness. The water filled mattress would also take up valuable space in the boat. In contrast, the waterbed and water mattress system of the instant invention can be emptied each morning and re-filled after one has traveled to one's new destination, or at the same dock/marina. Also, without the weight of the water in the waterbed mattress, a boat retains its original stability and sea worthiness. Both motor and sail boats can achieve greater speed. Also, a boat with a motor can achieve greater fuel efficiency while traveling somewhere.

Other objects and advantages of the invention are set out herein or are obvious herefrom to one skilled in the art.

The objects and advantages of the invention are achieved by the waterbed and water mattress system of the invention.

A waterbed is a mattress-shaped bag filled with water and placed on a bedframe or bunk, for making the surface conform to the user's or the sleeper's body in any position.

The invention waterbed mattress system includes a waterbed mattress (preferably having an upper layer, a lower layer and an inner layer and numerous longitudinal and transverse vertical layers creating many small cells or compartments, which each have at least several and, preferably, numerous holes in them) and means for transporting water or another liquid to and into the waterbed mattress from a body of water surrounding the boat, or from a water supply internal or external to boat. This water transportation means can be also used for transporting the water or other liquid from the waterbed mattress to and into the body of water surrounding the boat or to its internal or external source. The waterbed mattress system can also include separate means for heating the water or other liquid being transported to and into the waterbed mattress from the body of water surrounding the boat or to the internal or external supply. The waterbed mattress system can also include separate means for transporting the water from the waterbed mattress to and into the body of water surrounding the boat or to the internal or external supply.

The various valves used in the waterbed mattress system can be operated manually or automatically, preferably automatically by electronic remote control systems.

The various pumps used in the waterbed mattress system can be manual, mechanical or gravity powered, preferably with automatic pressure shut-off systems.

As used herein, the term 'tubes' includes pipes, hoses and other similar hollow conduits through which water or other liquid can flow. Preferably, the fixed tubes are made of materials, such as, stainless steel, bronze or rigid marine quality plastic, which resist corrosion in salt or brackish water. The tubes connected to the waterbed mattress are of a flexible material, preferably a marine quality flexible plastic or rubber.

If the boat is of sufficient size, two or more waterbeds can be present, in which case the water inlet and outlet systems preferably are branched so as to be parallel to one another, are entirely different systems or are a hybrid of a parallel/series arrangement.

The waterbed mattress can be used alone or on a bedstead or other bed frame. Also, the waterbed mattress(es) can be used in a bunk bed(s).

As used herein, the term boat(s) include powered and unpowered ship(s), submarines and other floating vessels. The boat can be propelled by, for example, oars, paddles, one or more sails or power (for example, by a diesel or a gasoline engine, mounted inboard or outboard the boat). The invention waterbed mattress system is particularly useful in cabin cruisers, sail boats, personalized trawlers, military ships, tankers, freighters, cargo ships, container ships, cruise boats and yachts. That is, the invention waterbed mattress system is useful in either pleasure boats, commercial or military boats.

The hull of the boat can be made of any suitable material such as fiberglass, steel, wood, alloys and/or composite materials.

Modifications and changes made to the waterbed mattress system can be effected without departing from the scope or spirit of the present invention. For example, whereas the waterbed probably usually will be used in the cabin or hole of a boat, it can be used on the deck of a boat, in a cockpit or other space.

DETAILED DESCRIPTION OF THE INVENTION

The invention waterbed mattress system includes a waterbed mattress and means for transporting water or other liquid to and into the waterbed mattress from a body of water surrounding the boat or a water (or other liquid) supply (not shown) internal or external to the boat.

Figure 1:
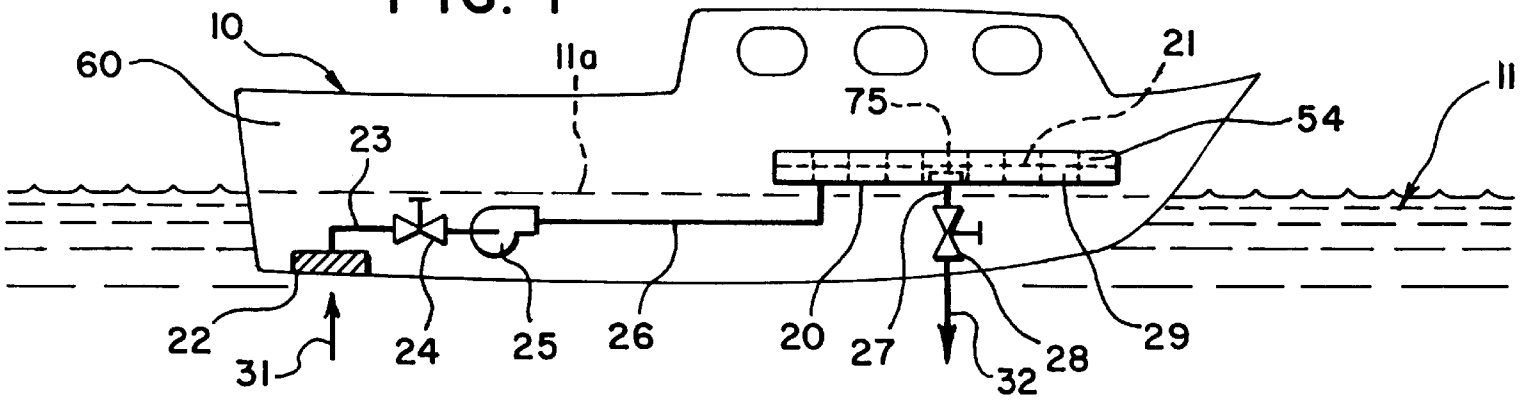
FIG. 1 is a side view of a boat having a cabin which is partially located beneath a deck and in which is housed a waterbed mattress.
Figure 2:
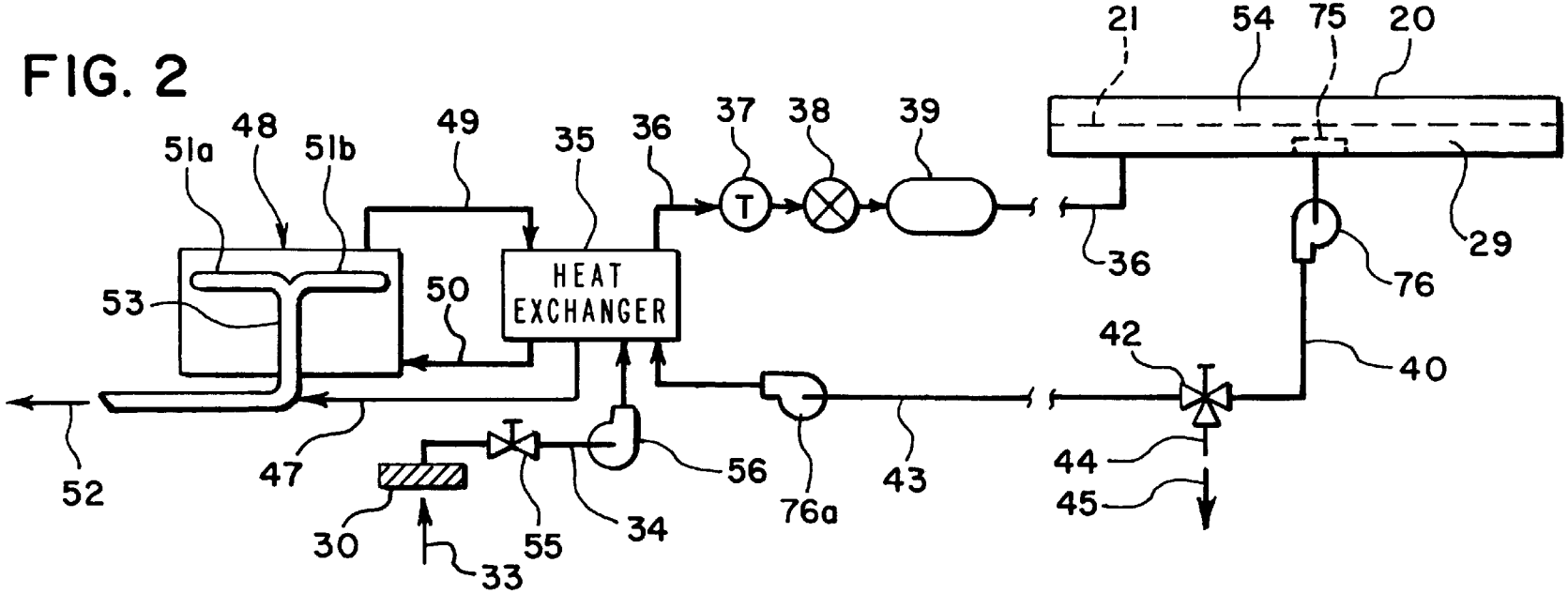
FIG. 2 is a side view of the water bed mattress system when it includes one waterbed mattress and means for transporting water to and into the waterbed mattress from a body of water surrounding the boat, from an internal or external supply, means for heating the water being transported to and into the waterbed mattress from the body of water surrounding the boat, and means for transporting the water from the waterbed mattress to and into the body of water surrounding the boat or to its internal or external source.
Figure 3:
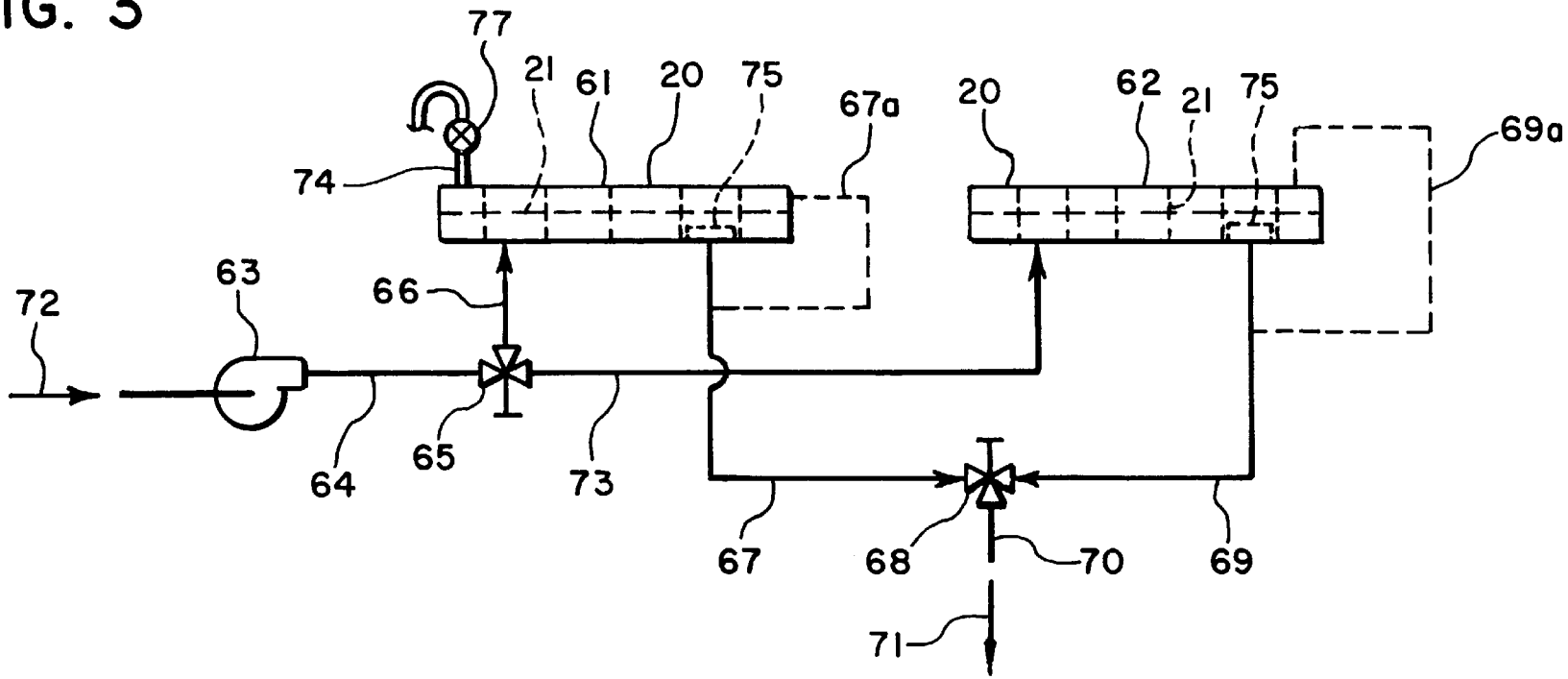
FIG. 3 is a side view of the waterbed mattress system when it includes at least two waterbed mattresses.

As is shown in FIG. 1, FIG. 2 and FIG. 3, the waterbed mattress (20) includes an upper level (54), a lower level (29) and an inner layer (21). The waterbed mattress may be either above, at or below the water line **(11*a*) of boat. The inner layer has numerous holes in it, so that the water may flow freely into the waterbed mattress and from the waterbed mattress. Also, in a time delayed manner, water may flow freely between the upper and lower, fore, aft, longitudinal and transverse layers, cells or compartments of the mattress. Because of this time impeded flow through the inner layer, cells or compartments (21), when one lays on the mattress the water adjustment in the mattress to the body shape is slowed, but not prevented. Also, if the angle of the boat and, hence, the waterbed mattress changes, sloshing is reduced, slowed or eliminated. The waterbed mattress (20) and internal layers, cells or compartments (21)** can be made of any suitable material, such as, a vinyl material.

As shown in FIG. 1, the means for transporting water or liquid to and into the waterbed mattress (20) from a body of water surrounding the boat or an internal supply such as a water tank or an external supply such as a dock hose, can include a filter or strainer (22), a first valve (one-way) (24), a pump (25), which may be motor driven, manual or gravity fed, a first tube (23) [which runs both between the filter or strainer (22) and the first valve (24) and between the first valve (24) and the pump (25)], a second valve (one-way) (28), and a third tube (27) [which runs both between the waterbed mattress (20) and the second valve (28) and between the second valve (28) and the body of water surrounding the boat].

The outer surface of the filter or strainer (22) preferably is flush with the outer surface of the hull (60) of the boat (10). The filter or strainer (22) prevents particulate matter larger than the holes in the filter or strainer (22) from entering the waterbed mattress system. Th outer surface of the filter or strainer (22) can be shaped so that a pumping-like action is achieved from movement of boat through the water, avoiding the need for a pump (25). Similarly, the outer surface of third tube (27) can be shaped to provide a pump-like action from movement of boat through the water, facilitating exit of water (32) from waterbed mattress and boat.

The first valve (one-way) (24) allows water to flow forwards to the pump (25). Each of the valves used in the invention, including first valve (24) can be operated either manually or automatically, preferably automatically, by an electronic remote control system.

The pump (25) allows one to control the speed of the flow of the water through the various tubes into the waterbed. Any suitable pumping device can be used, preferably one with an automatic pressure control switch. Care must be taken so as to not allow the water pressure in the mattress (20) to become to great [e.g., rupture the mattress (20)].

A means to automatically avoid the problem of overpressure and the potential for waterbed mattress rupture is an overflow pipe (74) with a one way valve (77) allowing overflow from a full waterbed mattress. The height of the overflow pipe (74) limits the maximum water pressure in the waterbed mattress; an alternative is an adjustable pressure relief check valve.

Another means to automatically avoid the problem of overpressure is to use a flow control meter (38) set to shut-off after allowing a pre-set volume of water or other liquid to be transported to an into the waterbed mattress. A pressure control or limiting valve may be used for valve (38). Also, all pressure control means can be used in concert together.

The end of the third tube (27) preferably is flush with the outer surface of the hull of the boat (60).

The second valve (one-way) (28) allows water to flow by gravitational force from the lower level of the waterbed mattress (20) into the body of water (11) surrounding the boat or other internal or external source.

The waterbed mattress (20) in FIG. 1 can be located higher in the cabin, in the cockpit or on the deck (10). If the waterbed mattress (20) in FIG. 1 is below the water line **(11*a*), then the pump (25) is not needed and a pump (not shown) is needed in the line (27). If the waterbed mattress (20) is at the water line both intake and outflow pumps may be used to facilitate use of the waterbed mattress. The water exiting the waterbed mattress and boat (45) can be passed back through tube (34) and filter (33), providing a back flush or cleaning function of filter (33)**, preventing clogging.

In FIG. 1, the boat (10) is shown floating in a body of water (11). The body of water can be, for example, a lake, river, estuary, bay, sea, ocean or the like. The hull (60) of the (10) boat can be made of any suitable material, such as, fiberglass, steel, wood, alloys and/or composite materials.

As shown in FIG. 2, a means for heating the water or other liquid being transported to and into the waterbed mattress from the body of water surrounding the boat or an internal or external supply can include a heat exchanger (35), a temperature gauge (37), a check valve, flow-control/limiter or pressure control/limiter valve, (38), a pressure expansion tank (39), a fifth tube [extending from the heat exchanger (35), to a temperature gauge for manual temperature control via valve (55) or automatic temperature control via a thermostat (37) or a digital or other adjustable automatic temperature control device, to the check valve (38), to the pressure expansion tank (39), to the waterbed mattress (54) via a tube (36) which is of a flexible material in the portion which attaches to the waterbed mattress], a fourth valve (two-way) (42), a sixth tube (40) the portion of which is attached to the waterbed mattress of a flexible material, [running between the waterbed mattress (20) and the fourth valve (42)], a seventh tube (43) [extending between the fourth valve (42) and the heat exchanger (35)], a strainer or filter (30), a third valve (one-way) (55), a pump (56), a fourth tube (34) [running both between the strainer or filter and the third valve (55), and between the third valve (55) and the heat exchanger (35)], an engine or generator (48), a manifold (53) [extending from the engine or generator to the body of water surrounding the boat (11), a eighth tube (47) [running from the heat exchanger (35) to the portion of the manifold or exhaust pipe (53) extending from the engine or generator (48), via two exhaust manifolds (51 and **51*b*)], and a water cycling system (49 and 50). Another means for heating water transported to the waterbed mattress is a solar heater or heater using fuel of any sort (both not shown) in lieu of heat exchanger (35)**.

The pressure expansion tank (39) can then be used to control the pressure in the mattress (20). The fourth valve (42) is a two-way valve. Through this valve (42), water can flow from the waterbed mattress (29) either into the body of water surrounding the boat (11) or can be recycled by means of the small pump (75) via the heat exchanger (35) into the mattress (20) to maintain the temperature of the waterbed mattress. Valve (42), recycling pump (75), pump (56), automatic temperature control via thermostat (37), valve (55) and pressure control device (38) can all be connected to a remote automatic control system.

The pump (56) can be used to control the speed of the flow of water from the body of water (11) surrounding the boat (10) through the filter or strainer (30) and into the heat exchanger (35). A third valve (one-way) (55) can also be present on the fourth tube (34) to control the flow of water from the body of water surrounding the boat into and from the heat exchanger (35).

A marine engine or generator cooling system (49 and 50) includes a ninth tube (49) running from the engine or generator or other heat source (48) to the heat exchanger (35) and a tenth tube (50) running from the heat exchanger (35) to the engine or generator (48). Water from the inlet water (34 and 36) can be inserted via the tube (47) into the exhaust manifold (53) to reduce pollutant particles in the exhaust fumes (52) exiting the exhaust manifold (53).

An alternative for an engine or generator which is cooled by passing water from outside the boat through the engine or generator (48) without a heat exchanger, is to use the water exiting from the engine or generator (48) to blend with the intake water in pipe (36) while maintaining sufficient flow via pipe (47) to provide exhaust manifold and exhaust pipe cooling, if present on engine or generator (48).

The temperature of the water in the waterbed mattress (20) can be kept at any suitable temperature, but it is usually kept at 92° to 96° F. when warmth is sought by the user or at 88° to 92° F. for cool sleeping or lower, if the user seeks to quickly cool down.

To maintain (or raise) a particular water temperature (range) in the waterbed mattress (20), water can be recycled using either drain/recycle pump (76) or recycle pump (76*a*) through the heat exchanger (35) as needed via the recycle line (see FIG. 2) to supply heated water to the mattress (20).

The strainer (75) is located on portion (29) of the water bed mattress (20) at the entrance to the exit tube (27). Exit tube (27) can be located on the lower, side or upper part of the waterbed mattress so as not to interfere with comfortable use of the waterbed mattress (67*a* and 69*a*) and still provide a secure connection protected from chaffing or abrasion. Additional safety valves (not shown) may be located as close as practical to waterbed mattress (20) and all other waterbed mattresses (61 and 62) in tubes connected to waterbed mattress to prevent unplanned or accidental discharge or draining of water or other liquid from waterbed mattress through any failure in the tubes, pumps, valves or connections. The purpose of the strainer (75) is to prevent the mattress (20) from collapsing [and blocking the top exit hole of tube (27)] due to too rapid exit of water or other liquid from the mattress (20). The strainer (75) is preferably about ¼ to ½ inch thick. The strainer (75) is composed of fibers, preferably soft, highly porous, flexible fiberglass, so as to allow the rapid exit flow of exiting water.

The engine or generator (48) can be, for example, an internal or external combustion and other cannot cycle engine, mounted inboard or outboard, using gasoline, diesel fuel or any other fuel which generates heat. The engine or generator can be a solar heater, an electric resistance heater or a heater using any fuel that produces heat. For internal and external combustion liquid-cooled marine engines and generators on pleasure and commercial boats, filter (30), valve (55), pipe (34) and pump (56) are usually present so that pipe (36) can be a branch of heat exchanger exit pipe (47). When 48 is an engine as opposed to a generator, it drives a shaft and a propellor (both not shown in the figures).

An electrical resistance heater (or other types of heater) can be installed in the water intake line (or water recycle line) or under or around the waterbed mattress to heat the water to be used in the waterbed when, for example, the boat is docked in a marina where engine heating is generally not used, desired or, in the case of winterized engine(s) or generator(s), not available.

FIG. 3 shows the possibility of including at least two waterbed mattresses as part of the waterbed mattress system. The waterbed mattress system shown in FIG. 3 includes two waterbed mattresses (61 and 62), a two-way sixth valve (68), a fourteenth tube (69) [running between the sixth valve (68) and one of the mattresses (62)], a thirteenth tube (67) [running between the sixth valve (68) and another mattress (61)], a pump (63), a two-way fifth valve (65), an eleventh tube (64) [running both between the water surrounding the boat (11) and the pump (63), and between the pump (63) and the fifth valve (65)], and a sixteenth tube (73) [extending from the fifth valve (65) to one of the mattresses (62)] a twelfth (66) [extending from the fifth valve (65) to another mattrrss (61)], and a fifteenth tube (70) [extending from the sixth valve (68) to the water source external or internal to the boat].

The pump (63) controls the flow of the water from the body of water (11) surrounding the boat (10) into one of the two mattresses (61 and 62), depending upon which direction the fifth valve (65) is channeling the water, that is, depending upon whether the valve (65) is open in the direction of mattress (61) or mattress (62).

A shaking or pulsing device (not shown) can be mounted with the waterbed mattress to provide a message-like, therapeutic, relaxing or stimulating sensation.

LIST OF PARTS NUMBERS

In connection with the figures, the following list of the names of the parts of the instant invention are noted:

10 deck of boat;
11 ocean or other body of water;
11*a* water line of boat;
20 first waterbed mattress;
21 horizontal, vertical, longitudinal and transverse porous inner layers, cells or compartments of first waterbed mattress;
22 filter or strainer;
23 first tube (running both between the filter or the strainer and the first valve and between the first valve and the pump);
24 first valve (one-way);
25 pump;
26 second tube (running between pump and waterbed mattress);
27 third tube (running both between waterbed mattress and second valve and between second valve and the ocean or other body of water or internal or external liquid supply);
28 second valve (one-way);
29 lower level of first waterbed mattress;
30 filter or strainer;
31 water or other liquid from ocean, other body or internal or external supply of liquid entering the filter or strainer;
32 water or other liquid exiting the second (one-way) valve and flowing into the ocean or other body of water or to the internal or external supply;
33 water or other liquid from ocean, other body of water or to the internal or external supply entering the filter or strainer;

34 fourth tube (running both between the strainer or filter and the third valve, and between the third valve and the heat exchanger);
35 heat exchanger;
36 fifth tube (running from the heat exchanger, to the temperature gauge, to the check valve, to the pressure expansion tank, to the waterbed mattress);
37 temperature gauge or thermostat;
38 check valve, flow meter/monitor with shut-off control, or pressure limiting valve;
39 pressure expansion tank;
40 sixth tube (running between the waterbed mattress and the fourth valve);
42 fourth valve (two-way);
43 seventh tube (running between the fourth valve and the heat exchanger);
44 water or other liquid entering the fourth valve from the waterbed mattress;
45 water or other liquid exiting the fourth valve and flowing into the ocean or other body of water or to the internal or external supply;
47 eighth line (running from the heat exchanger to the exhaust manifold or exhaust pipe);
48 engine, or generator or other heat source;
49 ninth tube (water or other liquid cycling line running from the engine or generator to the heat exchanger);
50 tenth tube (water or other liquid cycling line running from the heat exchanger to the engine or generator);
51*a* first exhaust manifold;
51*b* second exhaust manifold;
52 exhaust fumes exiting from the manifold;
53 exhaust pipe;
54 upper level of first waterbed mattress;
55 third valve (one-way);
56 pump (manual or motor driven);
60 hull of the boat;
61 second waterbed mattress;
62 third waterbed mattress;
63 pump (manual or motor driven);
64 eleventh tube (running both between the water surrounding the boat and the pump, and between the pump and the fifth valve);
65 fifth valve (two-way);
66 twelfth tube (running from the fifth valve to the second waterbed mattress);
67 thirteen tube (running from the second waterbed mattress to the sixth valve);
67*a* alternative water exit connection point;
68 sixth valve (two-way);
69 fourteenth tube (running between the sixth valve and the third waterbed mattress);
69*a* alternative water exit connection point;
70 fifteen tube (running between the sixth valve and the ocean or other body of water);
71 water or other liquid exiting the fourteenth line and flowing into the ocean or other body of water or to the external or internal source;
72 water or other liquid entering from the surrounding body of water or an internal or external supply into the tenth line running between the pump and fifth valve; and
73 a sixteenth tube (extending from the fifth valve to one of the two waterbed mattresses).
74 overflow (anti-rupture) pipe;
75 fiberglass strainer;
76 drain/recycle pump;
76*a* recycle pump;
77 check valve

What is claimed is:

1. A waterbed mattress system comprising:
(a) a boat;
(b) a waterbed mattress large enough for a person to lay prone upon; and
(c) means for transporting a liquid, which is water or another aqueous liquid, to and into the waterbed mattress from a supply of the liquid selected from the group consisting of (i) a body of water around the boat, (ii) a source of an aqueous liquid external to the boat other than the body of water around the boat and (iii) a source of an aqueous liquid internal to the boat.

2. The waterbed mattress system for the boat according to claim 1, wherein the means for transporting the liquid is a pressure generator selected from the group consisting of (i) a pump, (ii) hydrostatic pressure due to gravity, and (iii) pressure generated by water around the boat being forced into an opening in the hull due to motion of the boat.

3. The waterbed mattress system for the boat according to claim 2, wherein the means for transporting the liquid to and into the waterbed mattress from the supply includes a first tube which runs both between the supply and a first valve and between the first valve and the pressure generator and includes a second tube which runs between the pressure generator and an aperture in the waterbed mattress.

4. The waterbed mattress system for the boat according to claim 3, wherein the first valve is operated by an electronic control system through electromechanical operation of the first valve.

5. The waterbed mattress system for the boat according to claim 1, further comprising means for transporting the liquid from the waterbed mattress to and into the supply.

6. The waterbed mattress system for the boat according to claim 5, wherein the means for transporting the liquid from the waterbed mattress to and into the supply is by action of a pressure generator.

7. The waterbed mattress system for the boat according to claim 6, wherein the means for transporting the liquid from the waterbed mattress to and into the supply, further includes a fibrous, soft, highly porous, flexible material inside of the waterbed mattress over a first tube attached to an aperture in the waterbed mattress which allows, by action of the pressure generator, exit flow of the liquid in the waterbed mattress without interference from collapse of the emptying waterbed mattress, through the first tube running from the aperture in the waterbed mattress to the pressure generator, from the pressure generator to a first valve, and from the first valve to the supply.

8. The waterbed mattress system for the boat according to claim 7, wherein the first valve is operated by an electronic control system through electromechanical operation of the first valve.

9. The waterbed mattress system for the boat according to claim 1, further comprising means for controlling at least one member of the following group consisting of (i) temperature, (ii) pressure and (iii) volume of the liquid being transported to and into the waterbed mattress from the supply.

10. The waterbed mattress system for the boat according to claim 9, which the means to control at least one member of the following group consisting of (i) temperature, (ii) pressure and (iii) volume of the liquid being transported to and into the waterbed mattress from the supply, is selected from the group consisting of (i) a temperature regulator which has a temperature indicator means, (ii) a flow regulator, (iii) a flow limiting mechanism, (iv) an adjustable timer which regulates the length of time the flow regulator allows the liquid to be delivered to and into the waterbed mattress, (v) an overflow first tube running from an aperture in the waterbed mattress to a first valve to empty inside or outside of the boat, and (vi) a pressure expansion tank, and which further includes a source of heat selected from the group consisting of (i) an engine, (ii) a generator engine, (iii) an auxiliary engine, (iv) a heat source provided by fuel, (v) a heat source provided by a heat pump, (vi) a heat source provided by solar energy and (vii) a heat source provided by electricity, a heat exchanger, a second tube running from the heat exchanger to the aperture in the water mattress, a third tube extending from the source of heat to a circulating first pump, from there to the heat exchanger, from there to the source of heat, from there on to a connection to the supply, from there on to the pressure generator, and from there on to a second valve, a fourth tube extending from the connection to the supply to the second valve, to the pressure generator, and from there on to the heat exchanger, a two-way third valve, and a fifth tube extending from the aperture in the waterbed mattress to the two-way third valve and from the two-way third valve to the heat exchanger.

11. The waterbed mattress system for the boat according to claim 10, wherein the temperature, pressure, volume and flow of the heat transfer liquid transported to, into, circulated to and removed from the waterbed mattress is operated by an electronic control system through electromechanical operation of the valves, the pressure generators and the regulators of the waterbed mattress system.

12. The waterbed mattress system for the boat according to claim 1, wherein, between the lower surface and the upper surface of the waterbed mattress, is situated internal structures comprised of (i) inner horizontal layers, (ii) longitudinal and transverse vertical layers, and (iii) small cells or compartments which have holes in the walls of the cells or compartments, which internal structures, when the angle of the gravitational force holding the waterbed mattress in place is changed, reduce in a time delaying manner, any movement due to dynamics of motion of the boat, of any liquid remaining in the waterbed mattress after the waterbed mattress has been emptied, thereby preventing the liquid in the waterbed mattress from moving the emptied waterbed mattress from its location.

13. A waterbed mattress system comprising:

(a) a boat;

(b) a waterbed mattress large enough for a person to lay prone upon;

(c) means for transporting liquid, which is water or another aqueous liquid, to and into the waterbed mattress from a supply of the liquid selected from the group consisting of (i) a body of water around the boat, (ii) a source of an aqueous liquid external to the boat other than the body of water around the boat and (iii) a source of an aqueous liquid internal to the boat; and (d) a strainer or filter for the liquid being transported from the supply.

14. The waterbed mattress system for the boat according to claim 13, wherein the means for transporting the liquid is a pressure generator selected from the group consisting of (i) a pump, (ii) hydrostatic pressure due to gravity, and (iii) pressure generated by water around the boat being forced into an opening in the hull due to motion of the boat.

15. The waterbed mattress system for the boat according to claim 14, wherein the means for transporting the liquid to and into the waterbed mattress from the supply includes a first tube which runs from the supply through the strainer or filter to a first valve and then from the first valve to the pressure generator, and includes a second tube which runs between the pressure generator and an aperture in the waterbed mattress.

16. The waterbed mattress system for the boat according to claim 15, wherein the first valve is operated by an electronic control system through electromechanical operation of the first valve.

17. The waterbed mattress system for the boat according to claim 16, further comprising means for transporting the liquid from the waterbed mattress through the strainer or filter to and into the supply.

18. The waterbed mattress system for the boat according to claim 17, wherein the means for transporting the liquid from the waterbed mattress through the strainer or filter to and into the supply is by action of the pressure generator.

19. The waterbed mattress system for the boat according to claim 18, wherein the means for transporting the liquid from the waterbed mattress through the strainer or filter to and into the supply, further includes a fibrous, soft, highly porous, flexible material inside of the waterbed mattress over a first tube attached to an aperture in the waterbed mattress which allows, by action of the pressure generator, exit flow of the liquid in the waterbed mattress without interference from collapse of the emptying waterbed mattress, through the first tube running from the aperture in the waterbed mattress to the pressure generator, and from the pressure generator to a first valve, and on through the filter or strainer to the supply.

20. The waterbed mattress system for the boat according to claim 19, wherein the first valve is operated by an electronic control system through electromechanical operation of the first valve.

21. The waterbed mattress system for the boat according to claim 13, further comprising means for controlling at least one member of the following group consisting of (i) temperature, (ii) pressure and (iii) volume of the liquid being transported to and into the waterbed mattress from the supply.

22. The waterbed mattress system for the boat according to claim 21, wherein the means to control at least one member of the following group consisting of (i) temperature, (ii) pressure and (iii) volume of the liquid being transported to and into the waterbed mattress through the filter or strainer from the supply, is selected from the group consisting of (i) a temperature regulator which has a temperature indicator means, (ii) a flow regulator, (iii) a flow limiting mechanism, (iv) an adjustable timer which regulates the length of time the flow regulator allows the liquid to be delivered to and into the waterbed mattress, (v) an overflow first tube running from an aperture in the waterbed mattress to a first valve to empty inside or outside of the boat, and (vi) a pressure expansion tank, and which further includes a source of heat selected from the group consisting of (i) an engine, (ii) a generator engine, (iii) an auxiliary engine, (iv) a heat source provided by fuel, (v) a heat source provided by a heat pump, (vi) a heat source provided by solar energy and (vii) a heat source provided by electricity, a heat exchanger, a second tube running from the heat exchanger to the aperture in the waterbed mattress, a third tube extending from the source of heat to a circulating first pump, from there to the heat exchanger, from there to the source of heat, from there on to a connection to the supply, from there on to the pressure generator, and from there on to a second valve, a fourth tube extending from the connection to the supply to the filter or strainer, from there to the second valve, to the pressure generator, and from there on to the heat exchanger, a two-way third valve, and a fifth tube extending from the aperture in the waterbed mattress to the two-way third valve and from the two-way third valve to the heat exchanger.

23. The waterbed mattress system for the boat according to claim 22, wherein the temperature, pressure, volume and flow of the heat transfer liquid transported to, into, circulated to and removed from the waterbed mattress is operated by an electronic control system through electromechanical operation of the valves, the pressure generators and the regulators of the waterbed mattress system.

24. The waterbed mattress system for the boat according to claim 13, wherein, between lower surface and upper surface of the waterbed mattress, is situated internal structures comprised of (i) inner horizontal layers, (ii) longitudinal and transverse vertical layers, and (iii) small cells or compartments which have holes in the walls of the cells or compartments, which internal structures, when the angle of the gravitational force holding the waterbed mattress in place is changed, reduce in a time delaying manner, any movement due to dynamics of motion of the boat, of any liquid remaining in the waterbed mattress after the waterbed mattress has been emptied, thereby preventing the liquid in the waterbed mattress from moving the emptied waterbed mattress from its location.

25. A waterbed mattress system comprising:

(a) a boat;

(b) at least two waterbed mattresses, each large enough for a person to lay prone upon; and (c) means for transporting a liquid, which is water or another aqueous liquid, to and into each of the at least two waterbed mattresses from a supply of the liquid selected from the group consisting of (i) a body of water around the boat, (ii) a source of an aqueous liquid external to the boat other than the body of water around the boat and (iii) a source of an aqueous liquid internal to the boat.

26. The waterbed mattress system for the boat according to claim 25, wherein the means for transporting the liquid is a pressure generator selected from the group consisting of (i) a pump, (ii) hydrostatic pressure due to gravity, and (iii) pressure generated by water around the boat being forced into an opening in the hull due to motion of the boat.

27. The waterbed mattress system for the boat according to claim 26, wherein the at least two waterbed mattresses comprises a first and a second waterbed mattress, and wherein the means for transporting liquid to and into the first waterbed mattress from the supply, includes a first tube which runs from the supply through the supply and a first valve and between the first valve and the pressure generator, and includes a second tube which runs between the pressure generator and an aperture in the first waterbed mattress.

28. The waterbed mattress system for the boat according to claim 27, wherein the first valve is operated by an electronic control system through electromechanical operation of the first valve.

29. The waterbed mattress system for the boat according to claim 25, wherein the at least two waterbed mattresses comprises a first and a second waterbed mattress, and further comprising means for transporting the liquid from each of the at least two waterbed mattresses to and into the supply.

30. The waterbed mattress system for the boat according to claim 29, wherein the means for transporting the liquid from each of the first and the second waterbed mattresses to and into the supply is by action of a pressure generator.

31. The waterbed mattress system for the boat according to claim 30, wherein the means for transporting the liquid from the first waterbed mattress to and into the supply, further includes a fibrous, soft, highly porous, flexible material inside of the first waterbed mattress over a first tube attached to an aperture in the first waterbed mattress which allows, by action of the pressure generator, exit flow of the liquid in the first waterbed mattress without interference from collapse of the emptying first waterbed mattress, through the first tube running from the aperture in the first waterbed mattress to the pressure generator, from the pressure generator to a first valve and from the first valve to the supply.

32. The waterbed mattress system for the boat according to claim 31, wherein the first valve is operated by an electronic control system through electromechanical operation of the first valve.

33. The waterbed mattress system for the boat according to claim 25, wherein the at least two waterbed mattresses comprise at least a first and a second waterbed mattress, and further comprising means for controlling at least one member of the following group consisting of (i) temperature, (ii) pressure and (iii) volume of the liquid being transported to and into each of the first and second waterbed mattresses from the supply.

34. The waterbed mattress system for the boat according to claim 33, wherein the means to control at least one member of the following group consisting of (i) temperature, (ii) pressure and (iii) volume of the liquid being transported to and into each of the first and second waterbed mattresses from the supply, is selected from the group consisting of (i) a temperature regulator which has a temperature indicator means, (ii) a flow regulator, (iii) a flow limiting mechanism, (iv) an adjustable timer which regulates the length of time the flow regulator allows the liquid to be delivered to and into the first and second waterbed mattresses, (v) an overflow first tube running from an aperture in the first of at least two waterbed mattresses, to a first valve to empty inside or outside of the boat, and (vi) a pressure expansion tank, and which further includes a source of heat selected from the group consisting of (i) an engine, (ii) a generator engine, (iii) an auxiliary engine, (iv) a heat source provided by fuel, (v) a heat source provided by a heat pump, (vi) a heat source provided by solar energy and (vii) a heat source provided by electricity, a heat exchanger, a second tube running from the heat exchanger to the aperture in the first waterbed mattress, a third tube extending from the source of heat to a circulating first pump, from there to the heat exchanger, from there to the source of heat, from there on to a connection to the supply, from there on to the pressure generator, and from there on to a second valve, a fourth tube extending from the connection to the supply to the second valve, to the pressure generator, and from there on to the heat exchanger, a two-way third valve, and a fifth tube extending from the aperture in the first waterbed mattress to the two-way third valve and from the two-way third valve to the heat exchanger.

35. The waterbed mattress system for the boat according to claim 44, wherein the temperature, pressure, volume and flow of the heat transfer liquid transported to, into, circulated to and removed from each of first and second waterbed mattresses is operated by an electronic control system through electromechanical operation of the valves, the pressure generators and the regulators of the waterbed mattress system.

36. The waterbed mattress system for the boat according to claim 25, wherein the at least two waterbed mattresses comprises a first and a second waterbed mattress, and between lower surface and upper surface of each of the first and second waterbed mattresses, are situated internal structures comprised of (i) inner horizontal layers, (ii) longitudinal and transverse vertical layers, and (iii) small cells or compartments which have holes in the walls of the cells or compartments, which internal structures, when the angle of the gravitational force holding the first or the second waterbed mattress in place is changed, reduce in a time delaying manner, any movement due to dynamics of motion of the boat, of any liquid remaining in the first or second waterbed mattress after the first or second waterbed mattress has been emptied, thereby preventing the liquid in the first or second waterbed mattress from moving the emptied first or second waterbed mattress from its location.

37. A waterbed mattress system comprising:

(a) a boat;

(b) at least two waterbed mattresses, each large enough for a person to lay prone upon;

(c) means for transporting a liquid, which is water or another aqueous liquid, to and into each of the at least two waterbed mattresses from a supply of the liquid selected from the group consisting of (i) a body of water around the boat, (ii) a source of an aqueous liquid external to the boat other than the body of water around the boat and (iii) a source of an aqueous liquid internal to the boat; and (d) a strainer or filter for the liquid being transported from the supply.

38. The waterbed mattress system for the boat according to claim 37, wherein the means for transporting the liquid is a pressure generator selected from the group consisting of (i) a pump, (ii) hydrostatic pressure due to gravity, and (iii) pressure generated by water around the boat being forced into an opening in the hull due to motion of the boat.

39. The waterbed mattress system for the boat according to claim 38, wherein the at least two waterbed mattresses comprises a first and a second waterbed mattress, and wherein the means for transporting liquid to and into the first waterbed mattress from the supply, includes a first tube which runs from the supply through the strainer or filter to a first valve and then from the first valve to the pressure generator, and includes a second tube which runs between the pressure generator and an aperture in the first waterbed mattress.

40. The waterbed mattress system for the boat according to claim 39, wherein the first valve is operated by an electronic control system through electromechanical operation of the first valve.

41. The waterbed mattress system for the boat according to claim 37, wherein the at least two waterbed mattresses comprise a first and a second waterbed mattress, and further comprising means for transporting the liquid from each of the at least two waterbed mattresses through the strainer or filter to and into the supply.

42. The waterbed mattress system for the boat according to claim 41, wherein the means for transporting the liquid from each of the first and the second waterbed mattresses through the strainer or filter to and into the supply is by action of a pressure generator.

43. The waterbed mattress system for the boat according to claim 42, wherein the means for transporting the liquid from the first waterbed mattress through the strainer or filter to and into the supply, includes a fibrous, soft, highly porous, flexible material inside of the first waterbed mattress over a first tube attached to an aperture in the first waterbed mattress which allows, by action of the pressure generator, exit flow of the liquid in the first waterbed mattress without interference from collapse of the emptying first waterbed mattress, a first valve and the first tube running from the aperture in the first waterbed mattress to the pressure generator, and from the pressure generator to the first valve and on through the strainer or filter to the supply.

44. The waterbed mattress system for the boat according to claim 43, wherein the first valve is operated by an electronic control system through electromechanical operation of the first valve.

45. The waterbed mattress system for the boat according to claim 44, wherein the at least two waterbed mattresses comprise at least a first and a second waterbed mattress, and further comprising means for controlling at least one member of the following group consisting of (i) temperature, (ii) pressure and (iii) volume of the liquid being transported to and into each of the first and second waterbed mattresses from the supply.

46. The waterbed mattress system for the boat according to claim 45, wherein the means to control at least one member of the following group consisting of (i) temperature, (ii) pressure and (iii) volume of the liquid being transported to and into each of the first and second waterbed mattresses through the strainer or filter from the supply, is selected from the group consisting of (i) a temperature regulator which has a temperature indicator means, (ii) a flow regulator, (iii) a flow limiting mechanism, (iv) an adjustable timer which regulates the length of time the flow regulator allows the liquid to be delivered to and into the first and second waterbed mattresses, (v) an overflow first tube running from an aperture in the first of at least two waterbed mattresses, to a first valve to empty inside or outside of the boat, and (vi) a pressure expansion tank, and which further includes a source of heat selected from the group consisting of (i) an engine, (ii) a generator engine, (iii) an auxiliary engine, (iv) a heat source provided by fuel, (v) a heat source provided by a heat pump, (vi) a heat source provided by solar energy and (vii) a heat source provided by electricity, a heat exchanger, a second tube running from the heat exchanger to the aperture in the first waterbed mattress, a third tube extending from the source of heat to a circulating first pump, from there to the heat exchanger, from there to the source of heat, from there on to a connection to the supply, from there on to the pressure generator, and from there on to a second valve, a fourth tube extending from the connection to the supply to the filter or strainer, from there to the second valve, to the pressure generator, and from there on to the heat exchanger, a two-way third valve, and a fifth tube extending from the aperture in the first waterbed mattress to the two-way third valve and from the two-way third valve to the heat exchanger.

47. The waterbed mattress system for the boat according to claim 46, wherein the temperature, pressure, volume and flow of the heat transfer liquid transported to, into, circulated to and removed from each of first and second waterbed mattresses is operated by an electronic control system through electromechanical operation of the valves, the pressure generators and the regulators of the waterbed mattress system.

48. The waterbed mattress system for the boat according to claim 37, wherein the at least two waterbed mattresses comprises a first and a second waterbed mattress, and between lower surface and upper surface of each of the first and second waterbed mattresses, are situated internal structures comprised of (i) inner horizontal layers, (ii) longitudinal and transverse vertical layers, and (iii) small cells or compartments which have holes in the walls of the cells or compartments, which internal structures, when the angle of the gravitational force holding the first or the second waterbed mattress in place is changed, reduce in a time delaying manner, any movement due to dynamics of motion of the boat, of any liquid remaining in the first or second waterbed mattress after the first or second waterbed mattress has been emptied, thereby preventing the liquid in the first or second waterbed mattress from moving the emptied first or second waterbed mattress from its location.

* * * * *